US008337250B1

(12) United States Patent
Yang

(10) Patent No.: US 8,337,250 B1
(45) Date of Patent: Dec. 25, 2012

(54) ELECTRIC PLUG

(76) Inventor: Chen-Sheng Yang, Kaohsiung (TW)

( * ) Notice: Subject to any disclaimer, the term of this patent is extended or adjusted under 35 U.S.C. 154(b) by 0 days.

(21) Appl. No.: 13/242,021

(22) Filed: Sep. 23, 2011

(51) Int. Cl.
*H01R 13/22* (2006.01)

(52) U.S. Cl. ..... 439/620.22

(58) Field of Classification Search ..... 439/620.21, 439/620.22, 76.1, 490, 488, 350, 345, 446; 362/257, 253; 336/107; 338/220
See application file for complete search history.

(56) References Cited

U.S. PATENT DOCUMENTS

| | | | | |
|---|---|---|---|---|
| 4,834,664 | A * | 5/1989 | Lin | 439/145 |
| 5,556,308 | A * | 9/1996 | Brown et al. | 439/746 |
| 5,595,503 | A * | 1/1997 | Pittman et al. | 439/446 |
| 5,730,631 | A * | 3/1998 | Tsang | 439/881 |
| 6,099,338 | A * | 8/2000 | Huang | 439/350 |
| 6,290,533 | B1 * | 9/2001 | Major | 439/490 |
| 6,644,984 | B2 * | 11/2003 | Vista et al. | 439/76.1 |
| 7,210,969 | B1 * | 5/2007 | Hashimoto | 439/751 |
| 7,377,802 | B2 * | 5/2008 | Allen | 439/490 |
| 7,563,139 | B1 * | 7/2009 | Wang | 439/638 |
| 7,766,681 | B1 * | 8/2010 | Wang | 439/276 |
| 7,896,702 | B2 * | 3/2011 | Stiehl et al. | 439/620.22 |
| 8,047,873 | B1 * | 11/2011 | Wang | 439/589 |
| 8,226,424 | B1 * | 7/2012 | Wang et al. | 439/172 |

* cited by examiner

*Primary Examiner* — Alexander Gilman
(74) *Attorney, Agent, or Firm* — Hershkovitz & Associates, LLC; Abraham Hershkovitz

(57) ABSTRACT

An electric plug includes a casing, two metal contacting blades, a printed circuit board and a cap. The casing has a cavity defined in the casing. The two metal contacting blades are mounted in the casing and extend out from the casing. The printed circuit board is received in the cavity in the casing and has two metal clampers electrically connecting with the printed circuit board. Each clamper has two legs mounted on the printed circuit board and curved toward each other for securely clamping the contacting blade between the two legs and electrically conducting the contacting blade with the printed circuit board. The cap is mounted on the casing for closing the cavity in the casing. The clampers provide a high heat-resistance. The connections between clampers and the contacting blades are firm for providing a well conduction without wire or welding.

10 Claims, 5 Drawing Sheets

ELECTRIC PLUG

BACKGROUND OF THE INVENTION

1. Field of the Invention

The present invention relates to a plug, and more particularly to an electric plug.

2. Description of Related Art

A conventional electric plug includes a plastic casing, two metal contacting blades, a printed circuit board, two conducting wires and a connecting wire. The casing has a cavity defined in the casing for receiving the printed circuit board. The casing has a front end and a rear end. The two contacting blades are mounted in the front end of the casing and extend out from the casing. The two conducting wires are respectively mounted on the two contacting blades. Each contacting blade has two ends. One end of each contacting blade protrudes from the casing for inserting an insertion slot in an electric socket, the conducting wire extends through the other end of the contacting blade and is welded on the contacting blade and the printed circuit board for electrically connecting the contacting blade with the printed circuit board. The rear end of the casing has a channel defined in the casing for communicating the cavity with outside of the casing. The connecting wire is arranged in the channel and is welded on the printed circuit board for electrically connecting with an electric appliance.

However, the printed circuit board of the conventional electric plug will generate heat during operation, and especially transmit heat to the conducting wires between the two contacting blades and the printed circuit board, such that the conducting wires may easily melt after a long period of use. The melted conducting wires may cause the plastic casing to melt and short out the printed circuit board.

To overcome the shortcomings, the present invention tends to provide an electric plug to mitigate or obviate the aforementioned problems.

SUMMARY OF THE INVENTION

The main objective of the invention is to provide an electric plug that includes a casing, two metal contacting blades, a printed circuit board and a cap. The casing has a front end, a rear end opposite to the front end and a cavity defined in the casing. The two contacting blades are mounted in the casing and extend out from the front end of the casing. Each contacting blade has a first end protruding from the front end of the casing and a second end disposed in cavity in the casing. The printed circuit board is received in the cavity in the casing for electrically connecting an electric appliance and has two metal clampers electrically connecting with the printed circuit board and respectively mounted on the two contacting blades. Each clamper has two legs mounted on the printed circuit board and curved toward each other for securely clamping the second end of a corresponding contacting blade between the two legs of the clamper and electrically conducting the contacting blade with the printed circuit board. The cap is mounted on the casing for closing the cavity in the casing.

Each clamper has a bridge disposed between and connected with the two legs of the clamper for securely holding the second end of the corresponding contacting blade.

The casing has two stands formed on a bottom of the cavity and respectively supporting the second ends of the two contacting blades in the casing.

The cap has two braces extending from an inner bottom of the cap for respectively supporting the second ends of the two contacting blades in the casing and keeping the clampers clamping on the contacting blades.

Each brace has a cutout defined in an edge of the brace.

Other objects, advantages and novel features of the invention will become more apparent from the following detailed description when taken in conjunction with the accompanying drawings.

DETAILED DESCRIPTION OF PREFERRED EMBODIMENT

Figure 1:
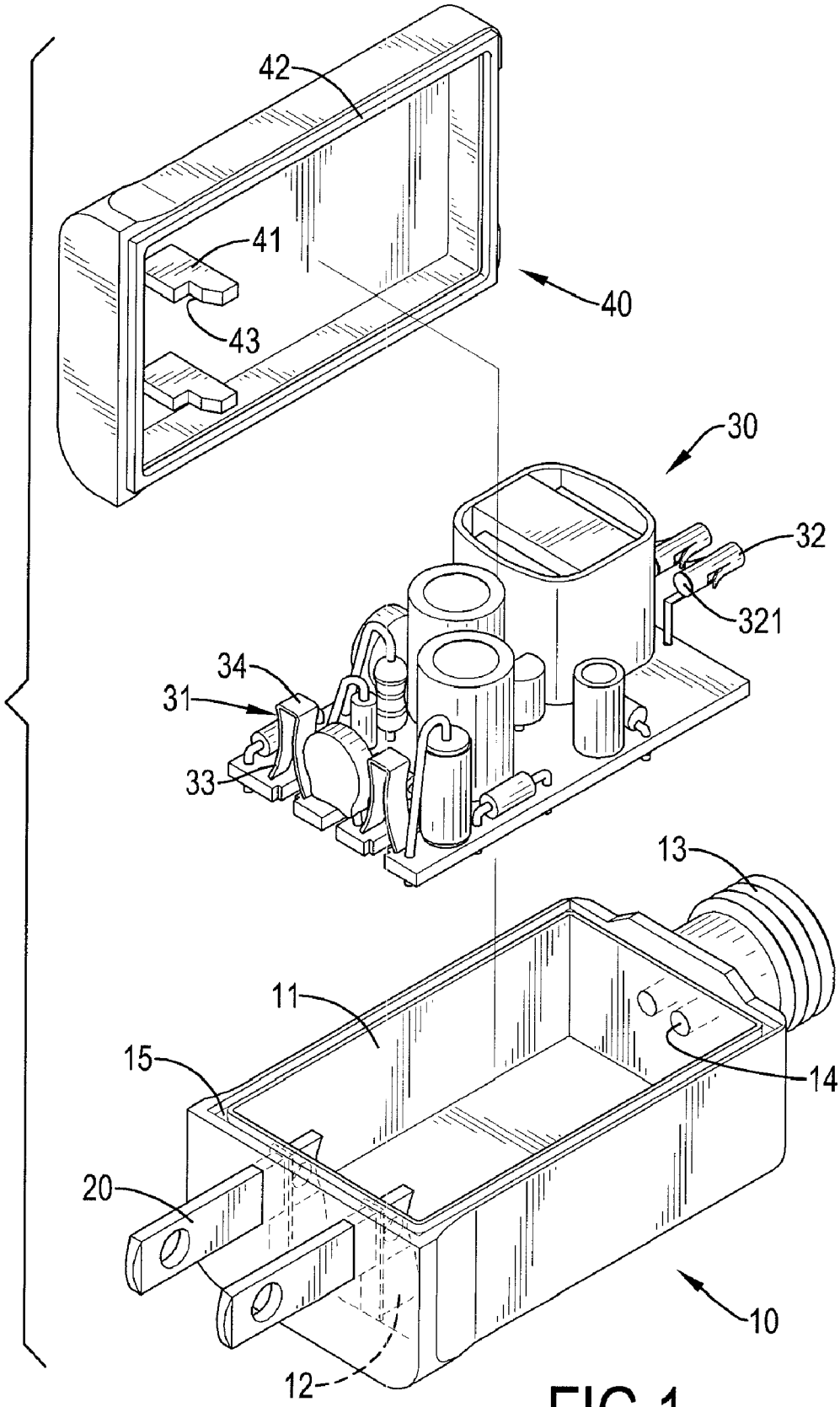
FIG. 1 is an exploded perspective view of an electric plug in accordance with the present invention.
Figure 2:
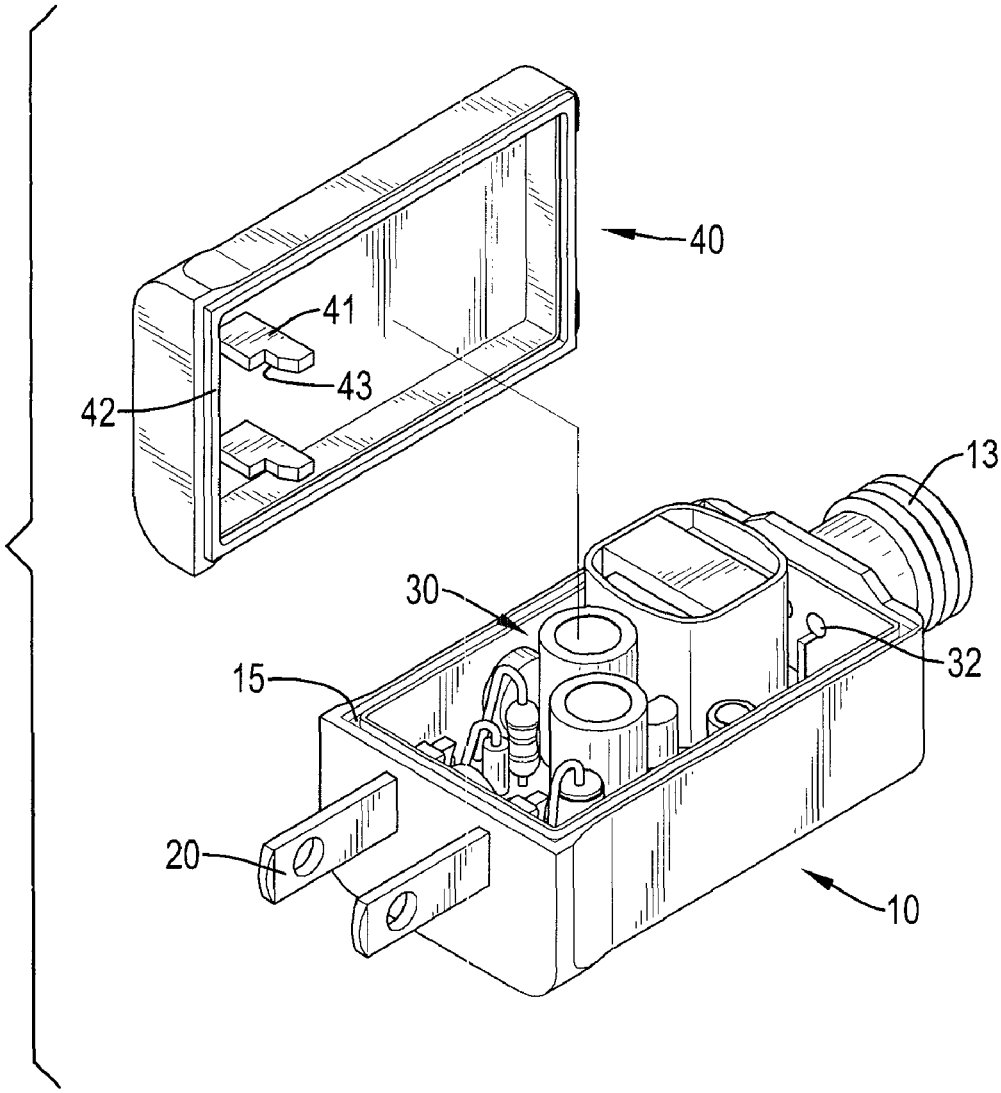
FIG. 2 is a partially exploded perspective view of the electric plug in FIG. 1.
Figure 3:
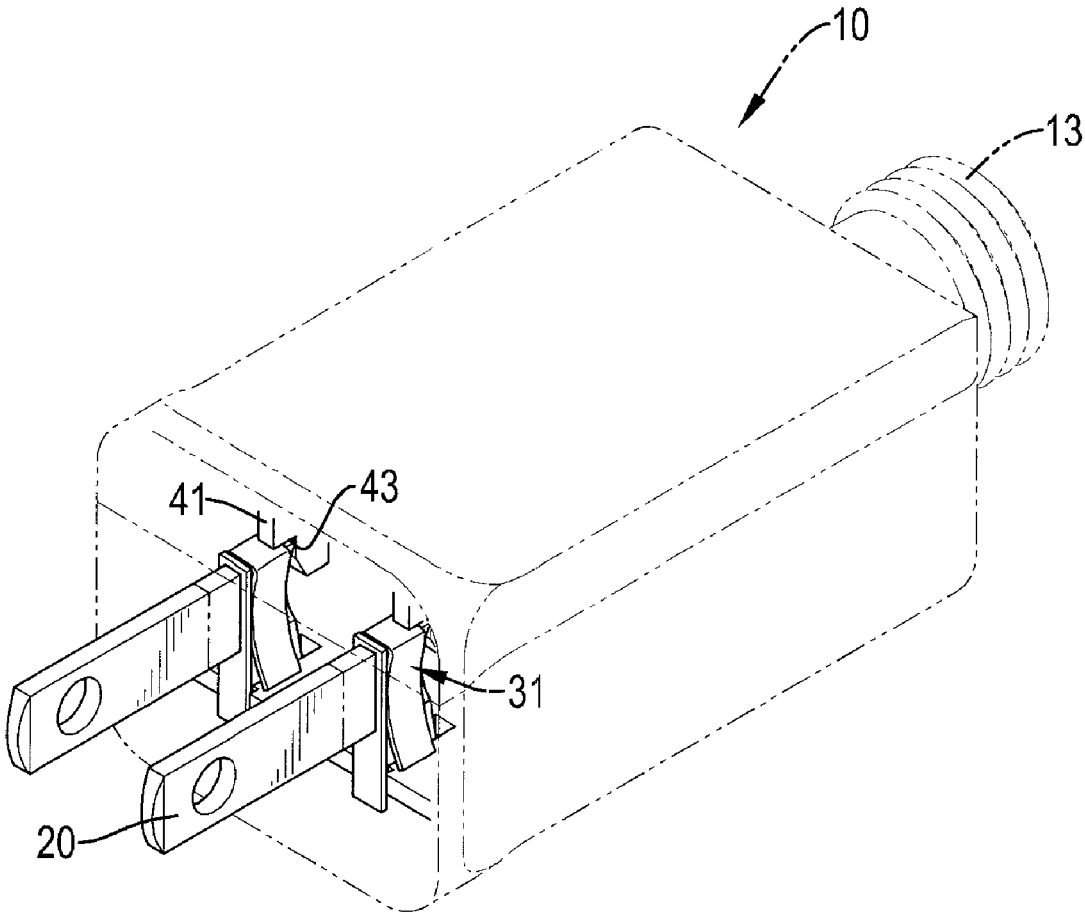
FIG. 3 is an assembled perspective view of the electric plug in FIG. 1 showing connections between contacting blades and clampers.

With reference to FIGS. 1 to 3, an electric plug in accordance with the present invention comprises a casing 10, two metal contacting blades 20, a printed circuit board 30, two tubular electric poles 32 and a cap 40.

The casing 10 has a front end provided for facing a socket and a rear end opposite to the front end provided for connecting with an appliance, preferably, a decorating illuminator. The casing 10 has a cavity 11, two stands 12, a tube 13, two channels 14 and an annular groove 15. The cavity 11 is defined in the casing 10. The two stands 12 are formed on a bottom of the cavity 11 and are located adjacent to the front end of the casing 10. The tube 13 is formed on the rear end of the casing 10. The two channels 14 are longitudinally defined in the tube 13 and communicate with the cavity 11 in the casing 10. The groove 15 is annularly defined in the top of the casing 10.

The two contacting blades 20 are mounted in the casing 10 and extend out from the front end of the casing 10. The two stands 12 of the casing 10 respectively support the two contacting blades 20. Each contacting blade 20 has a first end protruding from the front end of the casing 10 and a second end being supported by the contacting blade 20. The second end of each contacting blade 20 is located above the stand 12 and has a thickness equal to that of the stand 12.

The printed circuit board 30 is received in the cavity 11 in the casing 10 for electrically connecting the decorating illuminator. The printed circuit board 30 may convert an alternating current to a direct current, switch colors of the decorating illuminator, transform a voltage to the decorating illuminator, or be provided as a blinking circuit for the decorating illuminator. The printed circuit board 30 has two metal clampers 31 and two tubular electric poles 32. The two metal clampers 31 are electrically connected with the printed circuit board 30 and are located adjacent to the front end of the casing 10. The two clampers 31 are respectively mounted on the second ends of the two contacting blades 20. Each clamper 31 includes two legs 33 and a bridge 34. The legs 33 of each clamper 31 are mounted on the printed circuit board 30 and are curved toward each other for securely clamping the second end of a corresponding contacting blade 20 between the two legs 33 of the clamper 31 and electrically conducting the contacting blade 20 with the printed circuit board 30. The bridge 34 of each clamper 31 is located on the top of the clamper 31 and is connected between the two legs 33 of the damper 31 for securely holding the second end of the corresponding contacting blade 20. The two tubular electric poles 32 are electrically connected with the printed circuit board 30 and are located adjacent to the rear end of the casing 10. The two tubular electric poles 32 are respectively received in the two channels 14 in the tube 13 of the casing 10. Each electric pole 32 has two ends. One end of each electric pole 32 is hollow and extends in the channel 14 and the other end of the electric pole 32 is shielded by a cover 321. The two channels 14 are injected with glue for fixing the two electric poles 32 in the two channels 14. The cover 321 of each electric pole 32 is provided for preventing the glue from flowing through the electric pole 32.

Figure 4:
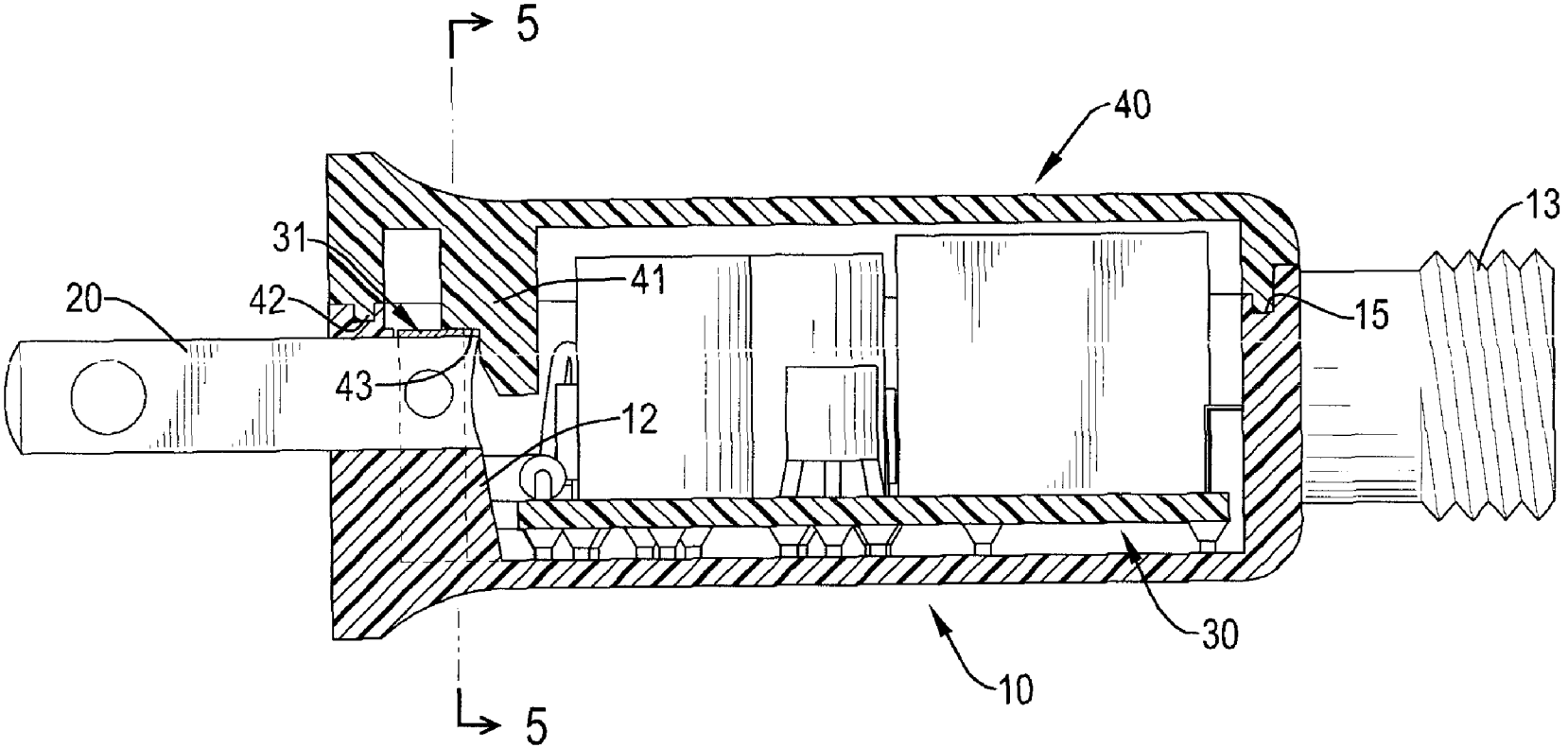
FIG. 4 is a side view in partial section of the electric plug in FIG. 3.

The cap 40 is mounted on a top of the casing 10 for closing the cavity 11 in the casing 10. The cap 40 has two braces 41 and a flange 42. The two braces 41 extend from an inner bottom of the cap 40 and are located adjacent to the front end of the casing 10. The two braces 41 are respectively mounted on the second ends of the two contacting blades 20 in the casing 10 for correspondingly and securely holding the two clampers 31 clamping on the two contacting blades 20. Each brace 41 has a cutout 43 defined in an edge of the brace 41 for fitting the bridge 34 of the corresponding clamper 31 and the second end of the corresponding contacting blade 20, such that the clamper 31 is kept on the contacting blade 20. With reference to FIG. 4, each brace 41 is located above the second end of the corresponding contracting blade 20 and has a thickness equal to that of the contacting blade 20. The contacting blade 20 and the corresponding damper 31 are squeezed between the corresponding brace 41 and the corresponding stand 12 for providing a supporting effort, strengthening a connection between the contacting blade 20 and the casing 10 and keeping the clamper 31 clamping on the contacting blade 20. The flange 42 extends from the cap 40 and is disposed along an edge of the cap 40 for being correspondingly inserted into the annular groove 15 in the casing 10, such that the cap 40 can tightly close the casing 10.

Figure 5:
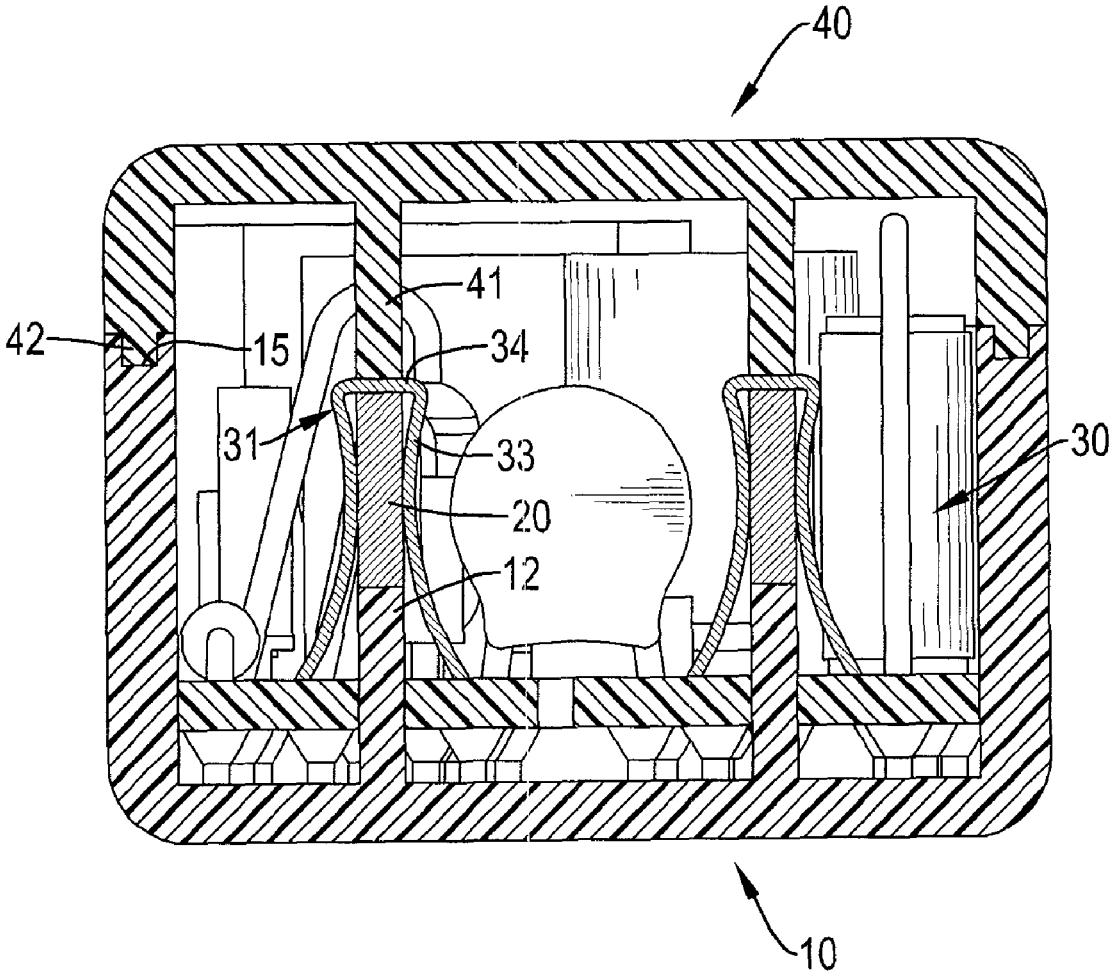
FIG. 5 is a front view in partial section of the electric plug in FIG. 4.

With reference to FIG. 5, each clamper 31 is metal and the two legs 33 are curved toward each other. The clamper 31 is substantially elastic due to a metal characteristic. A minimum distance between the two legs 33 of each clamper 31 is less than the thickness of the corresponding contacting blade 20 such that the contacting blade 20 is elastically and tightly clamped by the clamper 31 for ensuring that the contacting blade 20 electrically conducts with the printed circuit board 30. The braces 41 and the stands 12 are provided for holding the clampers 31 and the contacting blades 20 and keeping the clampers 31 clamping on the contacting blades 20. Compared with the conventional electric plug, there is no welding-wire between the contacting blades 20 and the printed circuit board 30. The metal clampers 31 provide higher heat-resistance than that of the thin wire and will not be melted easily. The connections between clampers 31 and the contacting blades 20 are firm for providing a well conduction without welding.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric plug comprising:

a casing having a front end, a rear end opposite to the front end and a cavity defined in the casing;

two metal contacting blades mounted in the casing and extending out from the front end of the casing, each contacting blade having a first end protruding from the front end of the casing and a second end disposed in cavity in the casing;

a printed circuit board received in the cavity in the casing for electrically connecting an electric appliance and having two metal dampers electrically connecting with the printed circuit board and respectively mounted on the two contacting blades, each clamper having two legs mounted on the printed circuit board and curved toward each other for securely clamping the second end of a corresponding contacting blade between the two legs of the clamper and electrically conducting the corresponding contacting blade with the printed circuit board; and a cap mounted on the casing for closing the cavity in the casing.

2. The electric plug as claimed in claim 1, wherein each clamper has a bridge disposed between and connected with the two legs of the clamper for securely holding the second end of the corresponding contacting blade.

3. The electric plug as claimed in claim 2, wherein the printed circuit board has two tubular electric poles electrically connected with the printed circuit board and located adjacent to the rear end of the casing, each electric pole has two ends, one end of each electric pole is hollow and extends toward the rear end of the casing and the other end of the electric pole is shielded by a cover.

4. The electric plug as claimed in claim 3, wherein the casing has two stands formed on a bottom of the cavity and respectively supporting the second ends of the two contacting blades in the casing.

5. The electric plug as claimed in claim 4, wherein the cap has two braces extending from an inner bottom of the cap for respectively supporting the second ends of the two contacting blades in the casing and keeping the clampers clamping on the contacting blades.

6. The electric plug as claimed in claim 5, wherein each brace has a cutout defined in an edge of the brace.

7. The electric plug as claimed in claim 1, wherein the printed circuit board has two tubular electric poles electrically connected with the printed circuit board and located adjacent to the rear end of the casing, each electric pole has two ends, one end of each electric pole is hollow and extends toward the rear end of the casing and the other end of the electric pole is shielded by a cover.

8. The electric plug as claimed in claim 1, wherein the casing has two stands formed on a bottom of the cavity and respectively supporting the second ends of the two contacting blades in the casing.

9. The electric plug as claimed in claim 1, wherein the cap has two braces extending from an inner bottom of the cap for respectively supporting the second ends of the two contacting blades in the casing and keeping the dampers clamping on the contacting blades.

10. The electric plug as claimed in claim 9, wherein each brace has a cutout defined in an edge of the brace.

* * * * *